US005280996A

United States Patent [19]

Trent

[11] Patent Number: 5,280,996

[45] Date of Patent: Jan. 25, 1994

[54] GLIDING-STYLE ROCKING CHAIR

[75] Inventor: B. C. Trent, Hancock, Tenn.

[73] Assignee: American Heirlooms, Bean Station, Tenn.

[21] Appl. No.: 833,969

[22] Filed: Feb. 11, 1992

[51] Int. Cl.[5] ..... A47C 3/02

[52] U.S. Cl. ..... 297/270; 297/272

[58] Field of Search ..... 297/258, 270, 272, 440, 297/442

[56] References Cited

U.S. PATENT DOCUMENTS

| | | | |
|---|---|---|---|
| 3,692,359 | 9/1972 | Boucher | 297/270 |
| 4,108,415 | 8/1978 | Hauray et al. | 297/273 X |
| 4,208,850 | 6/1980 | Collier | 297/440 X |
| 4,213,650 | 7/1980 | Sroub | 297/440 X |
| 4,601,513 | 7/1986 | Pine | 297/270 |
| 4,615,059 | 10/1986 | Darowski | 297/273 X |
| 4,796,949 | 1/1989 | Boyce | 297/270 X |
| 4,911,086 | 3/1990 | Belknap | 297/442 X |
| 4,911,499 | 3/1990 | Meeker | 297/270 X |
| 5,024,483 | 6/1991 | Kamman | 297/273 |

*Primary Examiner*—Kenneth J. Dorner

*Assistant Examiner*—Milton Nelson, Jr.

*Attorney, Agent, or Firm*—Pitts & Brittian

[57] ABSTRACT

An improved gliding-style rocking chair (10) provides a base (12) for continuous engagement of a support surface (94), wherein the base (12) does not move along the support surface (94) during use. Moreover, in the preferred embodiment, the improved gliding-style rocking chair (10) is designed to allow simple attachment of a seat (18) to the base (12). A seat support (16) is provided for the attachment of the seat (18). A plurality of pivoting members (54) is provided for pivotally connecting the base (12) and the seat support (16). At least one stop rod (60) is provided for limiting the motion of the seat support (16) in relation to the base (12). A damper (64) is provided for reducing the shock resulting from the contact between a first stop rod (60) and the base as the improved gliding-style rocking chair (10) is pushed to the rearward limit. A seat (18) is provided for the seating of a user. A plurality of seat connectors (78) is provided for connecting the seat (18) to the seat support (16). A plurality of cushions (20) may be provided as desired for the comfort of the user.

12 Claims, 4 Drawing Sheets

GLIDING-STYLE ROCKING CHAIR

TECHNICAL FIELD

This invention relates to the field of rocking chairs. More specifically, this invention relates to improvements in the field of gliding-style rocking chairs.

BACKGROUND ART

In the field of rocking chairs, it is well known that many undesirable characteristics are inherent in the traditional rocking chair. For example, when the traditional-style rocking chair is used, the ends of the rockers continuously oscillate toward and away from the floor. This may cause serious injury to the body of a person who accidently gets caught underneath. Animals have also been injured as well. Another undesirable characteristic of such rocking chairs is that during use, the chair has a tendency to slowly move across the floor.

In an attempt to overcome such problems, several gliding rockers have been devised so that the motion of the user is substantially the same as per the traditional styled rocking chairs. Gliding-style rocking chairs include a support frame which engages the floor and does not move substantially in relation thereto. However, several problems still remain with conventional gliding-style rocking chairs.

Namely, if the gliding-style rocking chair is maneuvered to reach the full backward motion, the seat portion collides with the frame, thereby causing a sudden impact between the two. This impact will momentarily lift the frame from the floor and the momentum obtained in the back-swing of the seat portion will move the gliding-style rocking chair along the floor in a direction toward the rear of the chair a distance dependant on the force of the impact. Therefore, when the conventional gliding-style rocking chairs are swung over a full range of motion, the problems of the traditional rocking chair reoccur.

Further, many conventional gliding-style rocking chairs are of such size that shipping is prohibited. Many shipping companies have restrictions as to the size of a parcel which may be shipped. Some gliding-style rockers are shipped in at least two pieces to avoid having to ship via trucking companies, which are traditionally more expensive and less efficient. However, assembling these gliding-style rocking chairs is typically very difficult for the average user.

Therefore, it is an object of this invention to provide a gliding-style rocking chair which provides a base means for continuous engagement of a support surface such as a floor, wherein the base means does not move along the floor during use.

Another object of the present invention is to provide a gliding-style rocking chair which may be assembled and disassembled quickly and easily, thereby allowing for shipping with most parcel carriers.

DISCLOSURE OF THE INVENTION

Other objects and advantages will be accomplished by the present invention which provides a base means for continuous engagement of a support surface such as a floor, wherein the base means does not move along the floor during use. Moreover, in the preferred embodiment, the improved rocking chair is designed to allow quick and easy assembly and disassembly of the seat assembly to the base frame.

A base means is provided for engaging the support surface and for supporting a seat means. The base means includes a support frame designed for transferring the weight of the improved rocking chair and a user to the support surface. The support frame is designed to remain stationary along the support surface during use of the improved rocking chair. The support frame of the preferred embodiment includes a pair of laterally disposed faces, the faces being held in relative position one to the other by a plurality of lateral braces. A bottom linear member of each face defines extending portions for preventing tilting of the improved rocking chair when in use. The top linear member defines extending portions for allowing stop rods to oscillate during use of the improved rocking chair.

A seat support is provided for the attachment of a seat means. The seat support includes an upper surface for contacting the bottom surface of the seat means. A face member is carried by each of the linear members, each face member being provided for attaching the seat support to the base means by way of a plurality of pivoting members.

A plurality of pivoting members is provided for pivotally connecting the base means and the seat support. In the preferred embodiment, the first end of a pivoting member is pivotally attached proximate each of the top corners of the base means. Respective second ends of the pivoting members are pivotally connected to the corresponding lower corners of the seat support.

At least one stop rod is provided for limiting the motion of the seat support in relation to the base means. In the preferred embodiment, first and second stop rods are provided for limiting the range of motion in both the forward and rearward directions. The stop rods also serve to fix the position of the respective forward pivoting members one to the other and the position of the respective rearward pivoting members one to the other.

A damping means is provided for reducing the shock resulting from the contact between the first stop rod and the base means as the improved rocking chair is pushed to the rearward limit. In the preferred embodiment, a depending notch is defined by the bottom edge of each of the forwardly extending portions of the base means top linear members proximate the point of contact of the first stop rod. A shock absorbing member is positioned over each of the depending notches and securely attached so that as the improved rocking chair is pushed to the rearward limit the first stop rod will engage the shock absorbing member. The shock absorbing member serves to slow the movement of the improved rocking chair such that when the rearward limit is reached, the velocity of the improved rocking chair is insufficient to cause a jarring of, and therefore movement of, the improved rocking chair with respect to the support surface.

A seat means is provided for the seating of a user. An attachment means is provided for connecting the seat means to the seat support. The attachment means includes a plurality of screw-type fasteners and corresponding nut-type connectors. A plurality of through openings is defined by the seat member for loosely receiving the screw-type fasteners. A plurality of corresponding openings is defined by the seat support frame for loosely receiving the screw-type fasteners and for closely receiving the nut-type connectors. Each opening defined by the seat member of the seat means may further define a countersink for receiving the head portion of a screw-type fastener.

Thus, a screw-type fastener may be inserted through corresponding openings defined by the seat member and the seat support frame and tightened within the nut-type connector secured within the opening defined by the seat support frame.

A cushion means may be provided as desired for the comfort of the user. The selected cushion means may include a seat cushion and a back cushion.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
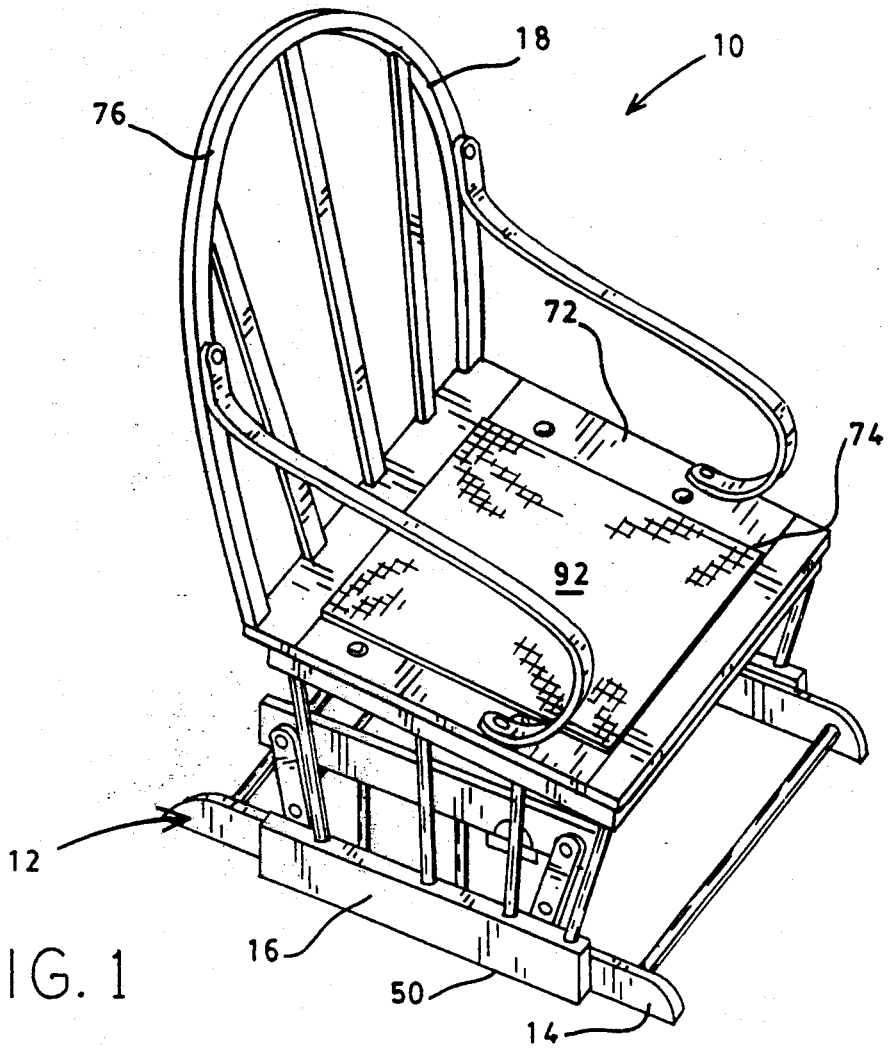
FIG. 1 a perspective view of the improved gliding-style rocking chair constructed in accordance with several features of the present invention.
Figure 2:
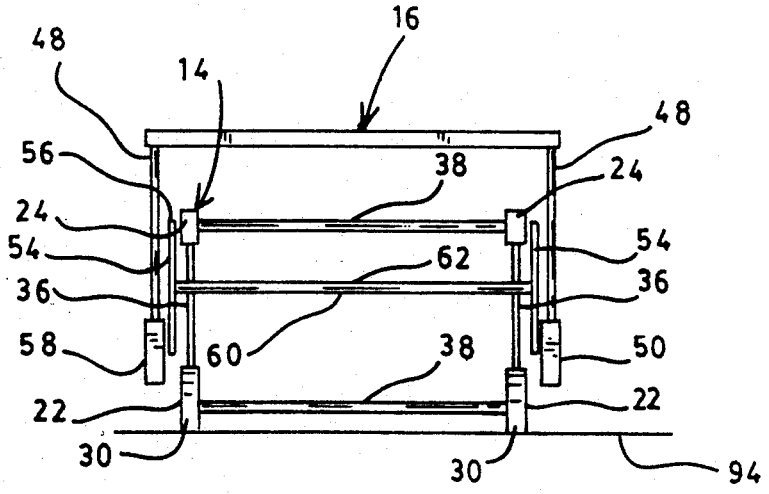
FIG. 2 illustrates a front elevation view of the base means and seat support of the improved gliding-style rocking chair of the present invention as shown in FIG. 1.
Figure 4:
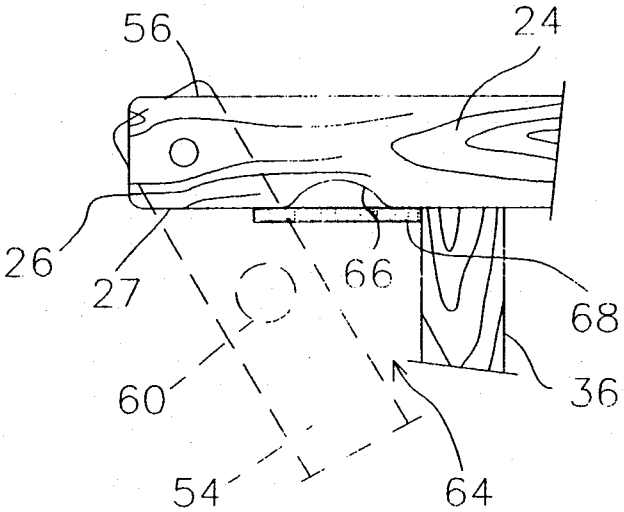
FIG. 4 partial side elevation view showing the engagement of a stop rod and the damping means of the improved gliding-style rocking chair of present invention as shown in FIG. 1.
Figure 3:
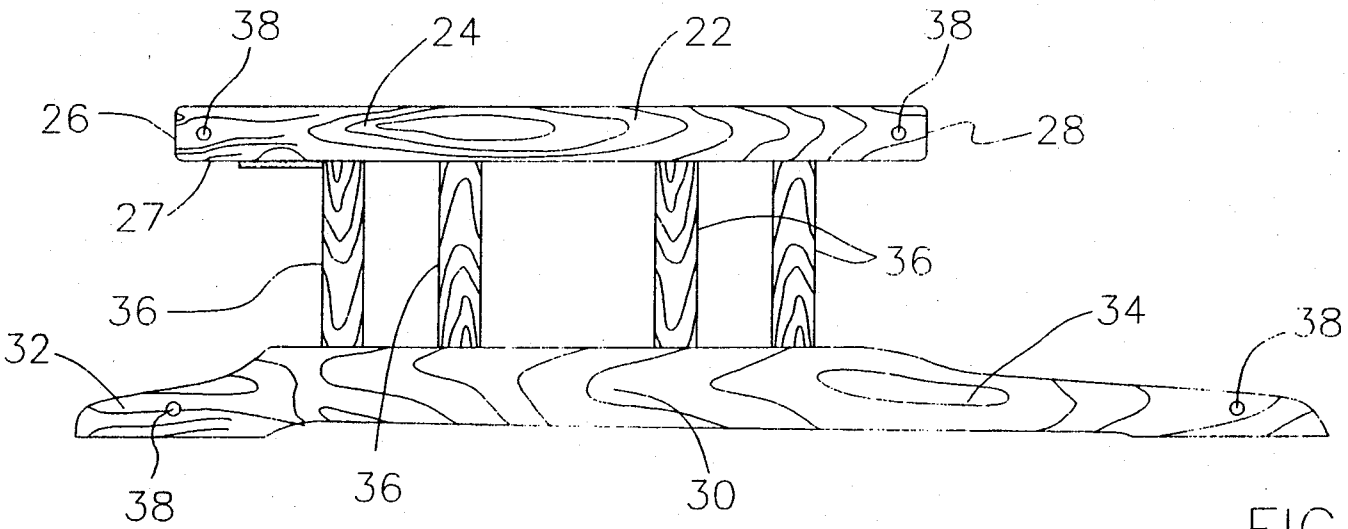
FIG. 3 is a side elevation of the base means of the improved gliding-style rocking chair of the invention as shown in FIG. 1.

An improved gliding-style rocking chair incorporating various features of the present invention is illustrated generally at 10 in the figures as is hereinafter referred to as the "improved rocking chair 10". The improved rocking chair 10 provides a base means 12 for continuous engagement of a support surface 94 such as a floor, wherein the base means 12 does not move along the floor during use. Moreover, in the preferred embodiment, the improved rocking chair 10 is designed to allow quick and easy assembly and disassembly of the seat assembly 18 to the base means seat support 16.

A base means 12 is provided for engaging the support surface 94 and for supporting a seat means 18. The base means 12 includes a support frame 14 designed for transferring the weight of the improved rocking chair 10 and a user to the support surface 94. The support frame 14 is designed to remain stationary along the support surface 94 during use of the improved rocking chair 10. The support frame 14 of the preferred embodiment includes a pair of laterally disposed faces 22, the faces being held in relative position one to the other by a plurality of lateral braces 38.

As shown in the figures, each face 22 includes a pair of vertically disposed linear members 24, 30 connected by a plurality of vertical members 36. It will be understood that the vertical members 36 may be replaced with a solid member (not shown), or any other suitable vertical support. The bottom linear member 30 defines extending portions 32, 34 for preventing tilting of the improved rocking chair 10 when in use. The top linear member 24 defines extending portions 26, 28 for allowing the first and second limiting members 60, 62, as described below, to oscillate during use of the improved rocking chair 10. As shown, the preferred embodiment includes at least a pair of lateral braces 38 for fixing the relative positions of the bottom linear members 30 and at least a pair of lateral braces 38 for fixing the relative positions of the top linear members 24.

Figure 5:
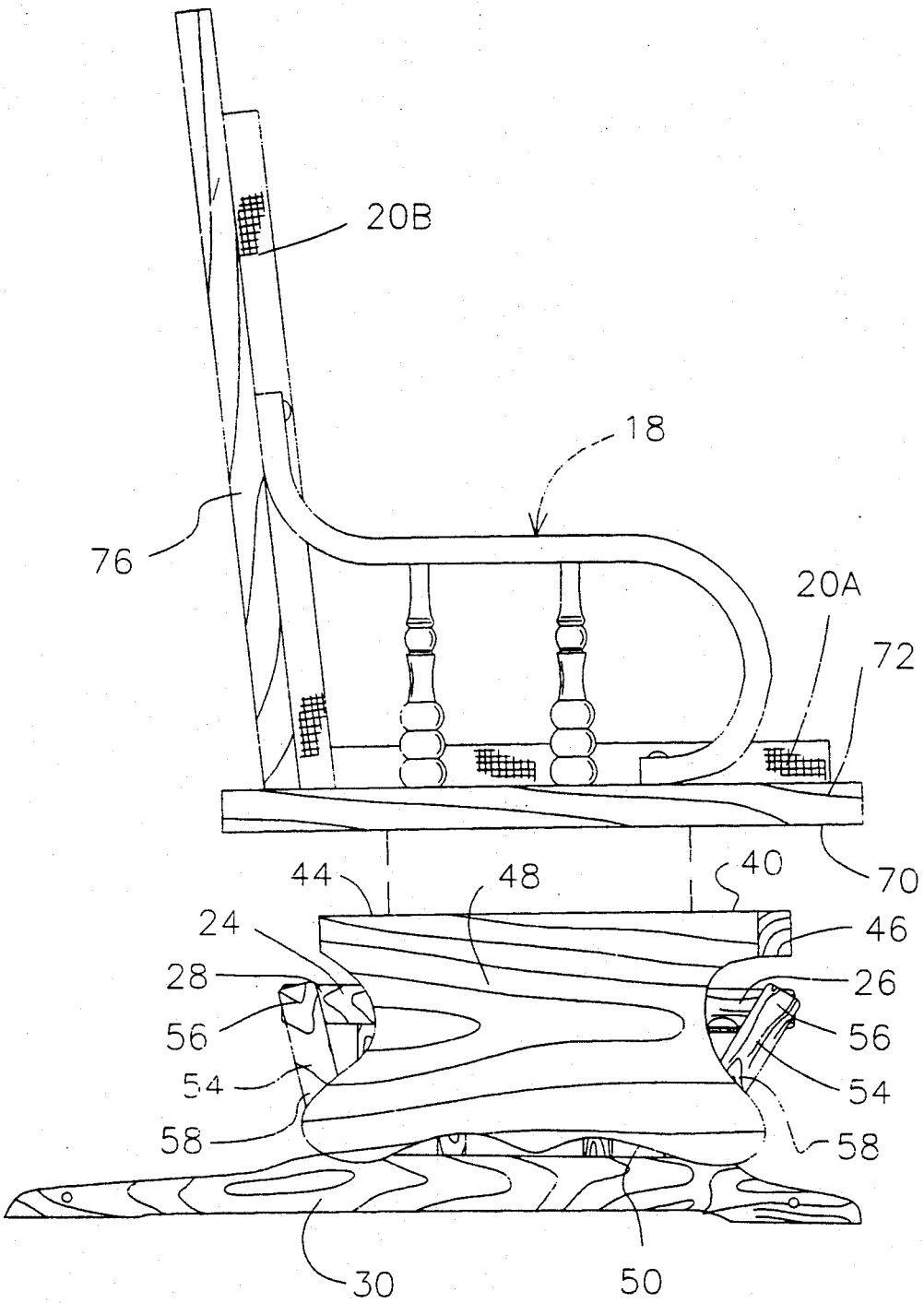
FIG. 5 is a side elevation showing the separation of the seat assembly from the seat support and base means of the improved gliding-style rocking chair of the present invention as shown in FIG. 1.
Figure 6:
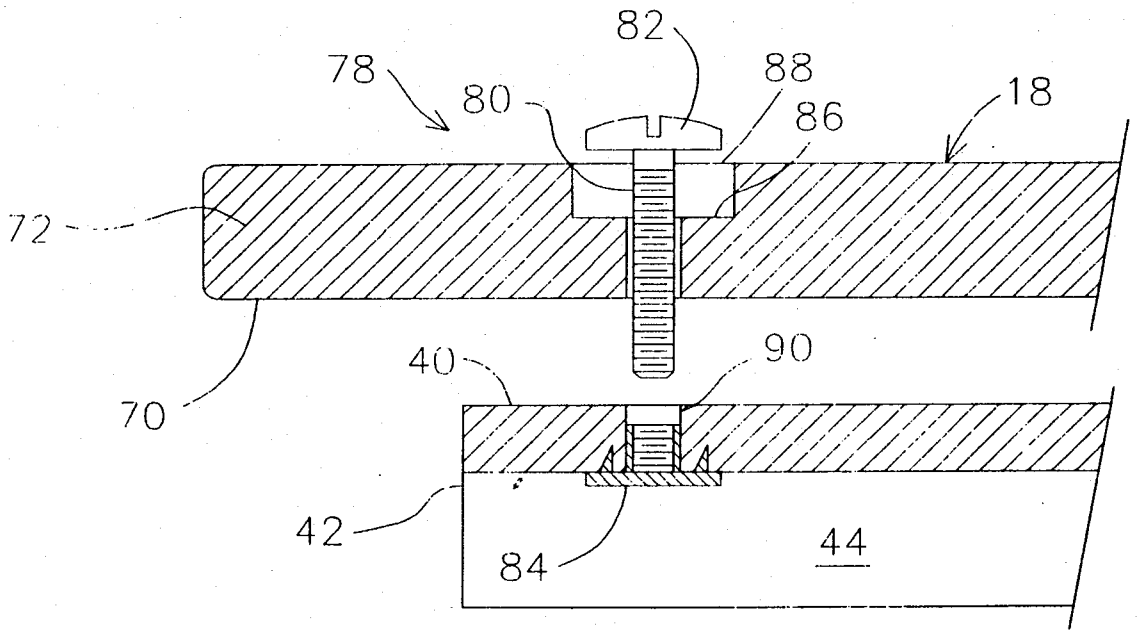
FIG. 6 partial side elevation, in section of the improved gliding-style rocking chair of the present invention as shown in FIG. 1 showing a preferred embodiment of the attachment means.

A seat support 16 is provided for the attachment of a seat means 18. The seat support 16 defines an upper surface 40 for contacting the bottom surface 70 of the seat means 18. As shown in the figures, the upper surface 40 may be defined by a frame 42 comprised of at least two laterally disposed linear members 44 and a lateral brace 46 for fixing the relative positions of the linear members 44. A face member 48 is carried by each of the linear members 44, each face member 48 depending downwardly from the respective linear member 44. The face members 48 are provided for attaching the seat support 16 to the support frame 14 by way of a plurality of pivoting members 54 as described below. In one preferred embodiment each face member 48 is a continuous member, as shown in FIG. 5. Each face member 48 extends downwardly to shield the support frame 14. In the preferred embodiment, the seat members 44 are spaced apart laterally a distance greater than that distance defined by the lateral spacing of the base means laterally disposed faces 22 such that the seat support 16 may be placed over the support frame 14 in such a way as to receive the support frame 14. It is conceivable that the support frame 14 may alternatively be configured to receive the seat support 16 in similar fashion.

A plurality of pivoting members 54 is provided for pivotally connecting the support frame 14 and the seat support 16. In the preferred embodiment, a pivoting member 54 is pivotally attached proximate each end 26, 28 of the top linear member 24 of each of the base means laterally disposed faces 22. Thus, as shown in the figures, four pivoting members 54 are incorporated in the improved rocking chair 10. Each pivoting member 54 is attached to the support frame 14 proximate a first end 56. Respective second ends 58 of the pivoting members 54 are pivotally connected to the corresponding face members 48 of the seat support 16 proximate a bottom edge 50. As shown in the figures, for a pair of pivoting members 54 connected to a common side of the improved rocking chair 10, the first ends 56 thereof are preferably spaced apart a distance greater than the distance defined between the respective second ends 58. The pivoting members 54 are dimensioned such that the seat support frame 42 is disposed above the base means support frame 14 such that the seat support 16 may be pushed forward and rearward in an unobstructed fashion for normal use of the improved rocking chair 10.

At least one limiting member 60 is provided for limiting the motion of the seat support 16 in relation to the support frame 14. In the preferred embodiment, first and second first and second limiting members 60, 62 are provided for limiting the range of motion in both the forward and rearward directions. A first limiting member 60 is connected to the pivoting members 54 pivotally attached to the respective forward extending portions 26 of the base means top linear members 24, heretofore referred to as the forward pivoting members 54A. A second limiting member 62 is connected to the pivoting members 54 pivotally attached to the respective rearward extending portions 28 of the base means top linear members 24, heretofore referred to as the rearward pivoting members 54B. The first and second limiting members 60, 62 also serve to fix the position of the respective forward pivoting members 54A one to the other and the position of the respective rearward pivoting members 54B one to the other.

The first limiting member 60 is provided for limiting the motion of the improved rocking chair 10 in the rearward direction. As the improved rocking chair 10 is pushed to the rearward limit, the first limiting member 60 is oscillated toward the rear of the improved rocking chair 10 until contact is made between the first limiting member 60 and the forwardly extending portions 26 of the base means top linear members 24.

The second limiting member 62 is provided for limiting the motion of the improved rocking chair 10 in the forward direction. As the improved rocking chair ID is pushed to the forward limit, the second stop rod 61 is oscillated toward the front of the improved rocking chair 10 until contact is made between the second limiting member 62 and the rearwardly extending portions 28 of the base means top linear members 24.

A damping means 64 is provided for reducing the shock resulting from the contact between the first limiting member 60 and the respective forwardly extending portions 26 of the base means top linear members 24 as the improved rocking chair 10 is pushed to the rearward limit. In the preferred embodiment, a depending notch 66 is defined by the bottom edge 27 of each of the forwardly extending portions 26 of the base means top linear members 24. The depending notches 66 are defined proximate the point of contact noted above. Thus, the range of motion in the rearward direction is increased by the depth of the depending notches 66. A shock absorbing member 68 is positioned over each of the depending notches 66 and securely attached. Thus, as the improved rocking chair 10 is pushed to the rearward limit the first limiting member 60 will engage the shock absorbing members 68. The shock absorbing members 68 serve to slow the movement of the improved rocking chair 10 such that when the rearward limit is reached, the velocity of the improved rocking chair 10 is insufficient to cause a jarring of, and therefore movement of, the improved rocking chair 10 with respect to the support surface 94.

In the preferred embodiment, the shock absorbing members 68 are fabricated from an elastomeric material such as rubber. The elastomeric properties of the shock absorbing members 68 prove beneficial as the first limiting member 60 reaches the rearward limit and the shock absorbing members 68 contact the respective inner surfaces of the depending portions 66. In such instances, the shock absorbing members 68 may be compressed for further shock absorption. Shock absorbing members 68 fabricated from an elastomeric material also serve to reduce the noise made when impact is made between the first stop rod 60 and the base means support frame 14.

A seat means 18 is provided for the seating of a user. The seat means 18 may be. configured in any selected manner with at least a seat member 72 and a back member 76. An attachment means 78 is provided for connecting the seat means 18 to the seat support 16. In the preferred embodiment, the attachment means 78 includes a plurality of screw-type fasteners 80 and corresponding nut-type connectors 84. A plurality of through openings 86 is defined by the seat member 72 for loosely receiving the screw-type fasteners 80. A plurality of corresponding openings 91 is defined by the seat support frame 42 for loosely receiving the screw-type fasteners so and for closely receiving the nut-type connectors 84. Each opening 86 defined by the seat member 72 of the seat means 18 may further define a countersink 88 for receiving the head portion 82 of a screw-type fastener 80.

A nut-type connector 84 is fixed within each opening 90 defined by the seat support frame 42. Thus, in order to attach the seat means 18 to the seat support 16, the seat means 18 is placed over the seat support 16 such that the corresponding openings 86, 90 are aligned. A screw-type fastener 80 is then placed in each opening 86 defined by the seat member 72. Each screw-type fastener 80 is thus introduced into the corresponding openings 90 defined by the seat support frame 42. Because a nut-type connector 84 is fixed within each opening 90 defined by the seat support frame 42, the only necessary step remaining is to tighten each screw-type fastener 80 within the corresponding nut-type connector 84.

A cushion means 20 may be provided as desired for the comfort of the user. The selected cushion means 20 may include a seat cushion 20A and a back cushion 20B. As shown in the figures, the seat member 72 of the seat means 18 may define an opening 74. In such a configuration, a covering member 92 is provided to prevent the seat cushion 21A from falling through the opening 74. The opening 74 defined by the seat member 72, in combination with the covering member 92, serves to soften the sitting portion of the seat member 72 for the further comfort of the user. The covering member 92 may be fabricated from wicker or some other material in which it is not desirable to employ cushions.

From the foregoing description, it will be recognized by those skilled in the art that an improved gliding-style rocking chair offering advantages over the prior art has been provided. Specifically, the improved gliding-style rocking chair provides a base means for continuous engagement of a support surface such as a floor, wherein the base means does not move along the floor during use. Moreover, in the preferred embodiment, the improved rocking chair is designed to allow quick and easy assembly and disassembly of the seat assembly to the base frame.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. An improved gliding style rocking chair comprising:

a base for engaging a support surface;

a seat support for supporting a load exerted by a user, said seat support being pivotally connected to said base such that as said user exerts a force in a selected direction along a central axis of said seat support, said seat support is moved in said direction and is tilted in a direction substantially similar to said direction of force;

a pivoting device for pivoting said seat support in relation to said base when said force is exerted on said seat support, said pivoting device including a plurality of connecting members each defining first and second ends, said first ends being pivotally connected to said base and said second ends being pivotally connected to said seat support;

a limiting device for limiting said movement said seat support when said force is applied, said limiting device being connected to at least one of said connecting members and being configured to engage said base when said seat support is displaced in a selected direction a selected distance, thereby preventing further displacement in said selected direction; and a damping member for minimizing displacement of said base in relation to said support surface upon said engagement of said limiting device and said base.

2. The improved gliding-style rocking chair of claim 1 wherein said damping member includes a recess and a shock absorbing member, said recess being defined by said base proximate a point impacted by said limiting device when said selected displacement is attained, said shock absorbing member being positioned over said recess such that as said selected displacement is attained, said limiting device engages said shock absorbing member such that said displacement of said seat support is gradually and substantially halted.

3. The improved gliding-style rocking chair of claim 1 wherein said limiting device includes a first limiting member for limiting said movement in a forward direction and a second limiting member for limiting said movement in a rearward direction.

4. The improved gliding-style rocking chair of claim 1 further comprising an attachment device for attaching a seat assembly to said seat support.

5. The improved gliding-style rocking chair of claim 4 wherein said attachment device includes a plurality of openings defined by said seat assembly and dimensioned to loosely receive a plurality of fasteners, a plurality of corresponding openings defined by said seat support and dimensioned to loosely receive said plurality of fasteners and for closely receiving a plurality of connectors, said plurality of fasteners being configured to cooperate with said connectors for securing said seat assembly to said seat support, said seat support defining an upper surface upon which said seat assembly may be supported in an unsecured fashion prior to said reception of said plurality of fasteners.

6. An improved gliding-style rocking chair comprising:

a base for engaging a support surface;

a seat support for supporting a load exerted by a user, said seat support being pivotally connected to said base such that as said user exerts a force in a selected direction along a central axis of said seat support, said seat support is moved in said direction and is tilted in a direction substantially similar to said direction of force;

a pivoting device for pivoting said seat support in relation to said base when said force is exerting on said seat support, said pivoting device including a plurality of connecting members each defining first and second ends, said first ends being pivotally connected to said base and said second ends being pivotally connected to said seat support;

a limiting device for limiting said movement of said seat support when said force is applied, said limiting device being connected to at least one of said connecting members and being configured to engage said base when said seat support is displaced in a selected direction a selected distance, thereby preventing further displacement in said selected direction; and a damping member for minimizing displacement of said base in relation to said support surface upon said engagement of said limiting device and said base, said damping member including a recess and a shock absorbing member, said recess defined by said base proximate a point impacted by said limiting device when said selected displacement is attained, said shock absorbing member being positioned over said recess such that as said selected displacement is attained, said limiting device engages said shock absorbing member such that said displacement of said seat support is gradually and substantially halted, and an attachment device for attaching a seat assembly to said seat support.

7. The improved gliding-style rocking chair of claim 6 wherein said attachment device includes a plurality of openings defined by said seat assembly and dimensioned to loosely receive a plurality of fasteners, a plurality of corresponding openings defined by said seat support and dimensioned to loosely receive said plurality of fasteners and for closely receiving a plurality of connectors, said plurality of fasteners being configured to cooperate with said connectors for securing said seat assembly to said seat support, said seat support defining an upper surface upon which said seat assembly may be supported in an unsecured fashion prior to said reception of said plurality of fasteners.

8. The improved gliding-style rocking chair of claim 6 wherein said limiting device includes a first limiting member for limiting said movement in a forward direction and a second limiting member for limiting said movement in a rearward direction.

9. An improved gliding-style rocking chair comprising:

a base for engaging a support surface;

a seat support for supporting a load exerted by a user, said seat support being pivotally connected to said base such that as said user exerts a force in a selected direction along a central axis of said seat support, said seat support is moved in said direction and is tilted in a direction substantially similar to said direction of force;

a pivoting device for pivoting said seat support in relation to said base when said force is exerted on said seat support, said pivoting device including a plurality of connecting members each defining first and second ends, said first ends being pivotally connected to said base and said second ends being pivotally connected to said seat support;

a limiting device for limiting said movement of said seat support when said force is applied, said limiting device being connected to at least one of said connecting members and being configured to engage said base when said seat support is displaced in a selected direction a selected distance, thereby preventing further displacement in said selected direction; and an attachment device for attaching a seat assembly to said seat support, said attachment device including a plurality of openings defined by said seat assembly and dimensioned to loosely receive a plurality of fasteners, a plurality of corresponding openings defined by said seat support and dimensioned to loosely receive said plurality of fasteners and for closely receiving a plurality of connectors, said plurality of fasteners being configured to cooperate with said connectors for securing said seat assembly support.

10. The improved gliding-style rocking chair of claim 9 wherein said seat support defines an upper surface upon which said seat assembly may be supported in an unsecured fashion prior to said reception of said plurality of fasteners.

11. The improved gliding-style rocking chair of claim 9 further comprising a damping member for minimizing displacement of said base in relation to said support surface upon said engagement of said limiting device and said base.

12. The improved gliding-style rocking chair of claim 9 wherein said limiting device includes a first limiting member for limiting said movement in a forward direction and a second limiting member for limiting said movement in a rearward direction.

* * * * *